US005888183A

United States Patent [19]

Ruthenberg et al.

[11] Patent Number: 5,888,183

[45] Date of Patent: Mar. 30, 1999

[54] METHOD OF WORKING PAPERBOARD BLANKS

[75] Inventors: Meyer L. Ruthenberg, Owings Mills; Barry E. Larkin, Timonium, both of Md.

[73] Assignee: United Container Machinery, Inc., Glen Arm, Md.

[21] Appl. No.: 840,106

[22] Filed: Apr. 11, 1997

[51] Int. Cl.[6] ..... B31B 1/14

[52] U.S. Cl. ..... 493/366; 493/60; 493/160; 493/355; 493/396; 493/478

[58] Field of Search ..... 493/58, 59, 60, 493/61, 355, 356, 396, 397, 464, 475, 478, 63, 64, 65, 66, 160, 81, 161, 178, 228, 240, 241, 384, 357, 359, 361, 365, 366, 370, 400, 402, 401, 404, 416, 463, 471, 477; 83/880, 879, 882, 49

[56] References Cited

U.S. PATENT DOCUMENTS

| | | | |
|---|---|---|---|
| 1,196,912 | 9/1916 | Weck | 493/396 |
| 3,257,882 | 6/1966 | Lulie | 493/60 |
| 3,456,565 | 7/1969 | Flaum et al. | 93/58.2 |
| 3,563,199 | 2/1971 | Wolfe . | |
| 3,882,765 | 5/1975 | Tokuno . | |
| 3,954,075 | 5/1976 | Jordan . | |
| 4,006,656 | 2/1977 | Shinomiya | 493/60 |
| 4,010,677 | 3/1977 | Hirakawa et al. | 93/58.2 |
| 4,026,176 | 5/1977 | Weiskopf | 83/502 |
| 4,033,217 | 7/1977 | Flaum et al. | 83/425.4 |
| 4,041,819 | 8/1977 | Chue et al. . | |
| 4,122,791 | 10/1978 | Brown . | |
| 4,132,157 | 1/1979 | Shinomiya | 93/58.1 |
| 4,137,829 | 2/1979 | Sarka . | |
| 4,214,495 | 7/1980 | Coburn | 83/425.4 |
| 4,215,609 | 8/1980 | Coburn . | |
| 4,224,847 | 9/1980 | Tokuno | 83/71 |
| 4,237,761 | 12/1980 | Coburn | 83/665 |
| 4,252,044 | 2/1981 | Yamashita et al. | 83/499 |
| 4,261,239 | 4/1981 | Toboshi et al. | 83/499 |
| 4,269,097 | 5/1981 | Linn | 83/482 |
| 4,328,727 | 5/1982 | Tokuno . | |
| 4,348,464 | 9/1982 | Khoury . | |
| 4,504,181 | 3/1985 | Khoury . | |

(List continued on next page.)

OTHER PUBLICATIONS

Prime Technology Sales Brochure, exact date unknown, pre–1990.

*Primary Examiner*—John Sipos
*Assistant Examiner*—Christopher W. Day
*Attorney, Agent, or Firm*—Biebel & French

[57] ABSTRACT

A method of working paperboard blanks is disclosed. The method includes providing first and second pairs of parallel rotary shafts supporting first and second pairs of tool heads respectively. The first pair of tool heads is moved to a predetermined longitudinal position along the first pair of shafts to define a first line of working. Likewise, the second pair of tool heads is moved to a predetermined longitudinal position along the second pair of shafts to define a second line of working wherein a center of the first line of working is displaced relative to a center of the second line of working. The paperboard blank is conveyed between the first and second pairs of tool heads to form a panel line on the paperboard blank. The tool heads may be automatically positioned along their respective shafts by coupling members which move linearly parallel to the shafts.

13 Claims, 12 Drawing Sheets

U.S. PATENT DOCUMENTS

| | | | |
|---|---|---|---|
| 4,515,052 | 5/1985 | Flaum | 83/479 |
| 4,516,454 | 5/1985 | Mosburger | 83/499 |
| 4,627,214 | 12/1986 | Anderson et al. | 83/71 |
| 4,649,782 | 3/1987 | Cavagna | 83/425.4 |
| 4,684,360 | 8/1987 | Seki et al. | 83/508.3 |
| 4,798,110 | 1/1989 | Tokuno et al. | 83/13 |
| 4,843,933 | 7/1989 | Seki et al. | 83/508.3 |
| 4,846,778 | 7/1989 | Hirakawa | 493/354 |
| 4,887,502 | 12/1989 | Voges | 83/479 |
| 4,926,730 | 5/1990 | Garrett | 83/499 |
| 4,934,237 | 6/1990 | Nienstedt | 83/49 |
| 5,057,068 | 10/1991 | Capdeboscq | 493/355 |
| 5,097,732 | 3/1992 | Tahara | 83/76.001 |
| 5,120,297 | 6/1992 | Adami | 493/355 |
| 5,123,891 | 6/1992 | Nieradka | 493/475 |
| 5,125,301 | 6/1992 | Miller et al. | 83/13 |
| 5,158,525 | 10/1992 | Nikkel | 493/475 |
| 5,181,899 | 1/1993 | Hill et al. | 493/355 |
| 5,297,464 | 3/1994 | Mayer | 83/499 |
| 5,373,721 | 12/1994 | Welsh et al. . | |

PRIOR ART

METHOD OF WORKING PAPERBOARD BLANKS

BACKGROUND OF THE INVENTION

1. Field of the Invention

The present invention relates to a method of working paperboard blanks and, more particularly, to a method of offsetting tool heads to form a panel line on a paperboard blank.

2. Related Prior Art

Boxes, such as those made from corrugated board or paperboard, are generally made by cutting a paperboard blank to the desired outside dimensions of the various walls and flaps, scoring the blank to form a crease line where the box is to be folded and slotting the blank to form the various flaps of the box. The crease lines and slotting lines are often referred to as "lines of working" on the paperboard blank. In conventional machines for forming box blanks, the tool heads for slotting and scoring the blanks are mounted in mating positions on successive pairs of shafts wherein each pair of shafts is oriented with one shaft above the other. Thus, the slotting and scoring operations take place serially as the blank is fed along a horizontal feed path into a nip as defined by blades or profiles on each set of mating tool heads on paired shafts.

Accurate scoring is critical to the squareness and joint gap control of the resulting box. The crease line formed by scoring must be wide enough to allow a fold to occur without rolling and thereby creating a false fold line. Further, the crease line should not be so narrow as to create cracking of the inside liner of the corrugated board, thereby weakening the box. However, a crease line which is too wide will lack adequate strength as it will tend to roll. The proper width of the crease line depends upon the thickness or caliper of the paperboard blank. For light weight papers and thin blank calipers, only a narrow crease line is required. However, to ensure proper box folding, heavy weight papers and thick blank calipers require a wider crease.

In the prior art methods associated with typical box forming machines, each crease line is formed by a series of mating scoring heads aligned in the direction of board travel wherein the successive scoring profiles share a common center axis. This prior art process is often referred to as an in-line arrangement of scoring heads. Each successive downstream set of mating scoring heads produces a score line superposed over the preceding score line such that each score line shares a common longitudinal axis resulting in a crease line centered on such axis.

In order to change the width of the resulting crease line in this prior art process, each set of mating scoring heads along the common longitudinal axis is replaced with another set of heads having scoring profiles of a different width. A plurality of scoring heads having different width profiles are typically located along each supporting shaft. When crease lines of a different width are desired, the scoring heads must be manually repositioned along their respective shafts such that the scoring profiles of desired width are aligned for engaging the corrugated board. Further, attempts to produce crease lines of varying widths in a conventional in-line arrangement of scoring heads has often resulted in increased crushing pressures and cracking, especially when light weight liners or thin board calipers are used.

In response to the limitations of traditional scoring or creasing methods, "dual" or "progressive" scoring has been proposed wherein crease lines are formed by a primary pair of mating scoring heads followed by a secondary pair of mating scoring heads, each pair having scoring profiles of a different shape to ensure a well defined crease line. However, progressive scoring utilizes a traditional in-line arrangement of scoring profiles in that the profiles of both the primary scoring heads and secondary scoring heads share a common center axis thereby requiring the replacement of scoring heads when a change in crease line width is desired.

In addition to forming crease lines of desired width, conventional methods of working paperboard blanks include forming slotting lines by passing the blank between mating slotting heads. Each slotting line is usually associated with a crease line to define a single panel line wherein the slotting line typically shares a common longitudinal axis with the crease line. It is sometimes desirable, however, to offset the slotting line from its associated crease line such that the flaps of the resulting box may be folded in a particular configuration. When such offsetting is desired, the prior art methods require that the slotting and scoring heads be manually repositioned along their respective shafts such that the center axes of the slotting and scoring lines are spaced apart by the desired offset.

This manual repositioning of tool heads has proven to be a time consuming task resulting in decreased production efficiency. Typically, the machine operator must physically enter the working area of the machine to manually disengage the tool heads from their respective shafts and then push the tool heads to their new positions.

Accordingly, there is a need for a method of scoring paperboard blanks to form a crease line wherein the width of the crease line may be easily varied without requiring the replacement of the scoring tool heads. In addition, there is a need for such a method for producing a well-defined crease line without cracking the paperboard blank. Further, there is a need for a method of displacing tool heads to form offset lines of working on a paperboard blank without requiring the manual repositioning of the tool heads.

SUMMARY OF THE INVENTION

A first embodiment of the present invention provides a method of scoring paperboard blanks in a machine for working paperboard blanks conveyed in a horizontal direction through the machine. The method includes providing a first pair of parallel rotary shafts arranged one over the other and supporting a first pair of scoring heads comprising first upper and lower cooperating scoring heads. A second pair of parallel rotary shafts is provided wherein the shafts are arranged one over the other. A second pair of scoring heads comprising second upper and lower cooperating scoring heads are supported upon the second pair of shafts. The first pair of scoring heads are moved to a predetermined longitudinal position along the first pair of shafts to define a first line of scoring. A second line of scoring is defined by moving the second pair of scoring heads to a predetermined longitudinal position along the second pair of shafts wherein a center of the first line of scoring is displaced relative to a center of the second line of scoring.

A paperboard blank is conveyed horizontally between the first and second pairs of scoring heads whereby the scoring heads form a crease line of a predetermined width on the paperboard blank. The predetermined width of the crease line is greater than a width of either the first or second lines of scoring wherein the lines of scoring may be overlapping or immediately adjacent to each other. A crease line comprising overlapping lines of scoring defines an area about which a single fold of the paperboard blank is formed. Lines of scoring which are immediately adjacent to each other create a crease line defining an area about which a pair of folds of the paperboard blank are formed to create a hinge.

The method of the present invention may further include the step of changing the displacement of the center of the second line of scoring relative to the center of the first line of scoring to change the width of the crease line for paperboard blanks of different thickness or caliper. This relative repositioning may be accomplished by simply displacing one of the first and second pairs of scoring heads relative to the other pair of scoring heads.

The method of the present invention may further include providing a third pair of scoring heads supported on the first pair of shafts and a fourth pair of scoring heads supported on the second pair of shafts. The third pair of scoring heads are positioned to a predetermined longitudinal position along the first pair of shafts in spaced relation to the first pair of scoring heads to define a third line of scoring. A fourth line of scoring is defined by positioning the fourth pair of scoring heads to a predetermined longitudinal position along the second pair of shafts in spaced relation to the second pair of scoring heads wherein a center of the third line of scoring is displaced relative to a center of the fourth line of scoring.

As the paperboard blank is conveyed horizontally through the machine between the third and fourth pairs of scoring heads, the third and fourth pairs of scoring heads form a second crease line of a predetermined width on the paperboard blank at a location spaced from the crease line formed by the first and second pairs of scoring heads. The width of the crease line may be changed for paperboard blanks of different thickness or caliper by changing the displacement of the center of the fourth line of scoring relative to the center of the third line of scoring. This relative repositioning may be accomplished by simply displacing one of the third and fourth pairs of scoring heads relative to the other pair of scoring heads.

A further embodiment of the present invention provides a method of working paperboard blanks by scoring, slotting or a combination thereof. The method includes providing a first pair of parallel rotary shafts arranged one over the other and supporting a first pair of tool heads comprising first upper and lower cooperating tool heads. A second pair of parallel rotary shafts, arranged one over the other, support second upper and lower cooperating tool heads. First and second coupling members are provided wherein the first coupling member is associated with the first pair of parallel rotary shafts and the second coupling member is associated with the second pair of parallel rotary shafts.

The first coupling member is linearly moved to a position adjacent the first pair of tool heads. The first coupling member is then moved for positioning the first pair of tool heads at a predetermined longitudinal position along the first pair of shafts to define a first line of working.

In a similar fashion, the second coupling member is linearly moved to a position adjacent the second pair of tool heads. A second line of working is defined by moving the second coupling member and thereby positioning the second pair of tool heads at a predetermined longitudinal position along the second pair of shafts. A center of the first line of working is displaced relative to a center of the second line of working.

A paperboard blank is conveyed horizontally between the first and second pairs of tool heads whereby the tool heads form a panel line on the paperboard blank. Each of the first and second lines of working may comprise either a line of scoring or a line of slotting.

Therefore, it is an object of the present invention to provide a method of scoring paperboard blanks to form a crease line wherein the width of the crease line may be easily changed.

It is a further object of the invention to provide such a method wherein the width of the crease line may be changed without replacing the scoring tool heads.

It is yet another object of the invention to provide such a method wherein a well defined crease line is formed without cracking the paperboard.

It is an additional object of the invention to provide a method of displacing tool heads to form offset lines of working on a paperboard blank without requiring the manual repositioning of the tool heads.

Other objects and advantages of the invention will be apparent from the following description, the accompanying drawings and the appended claims.

DETAILED DESCRIPTION OF THE PREFERRED EMBODIMENT

Figure 1:
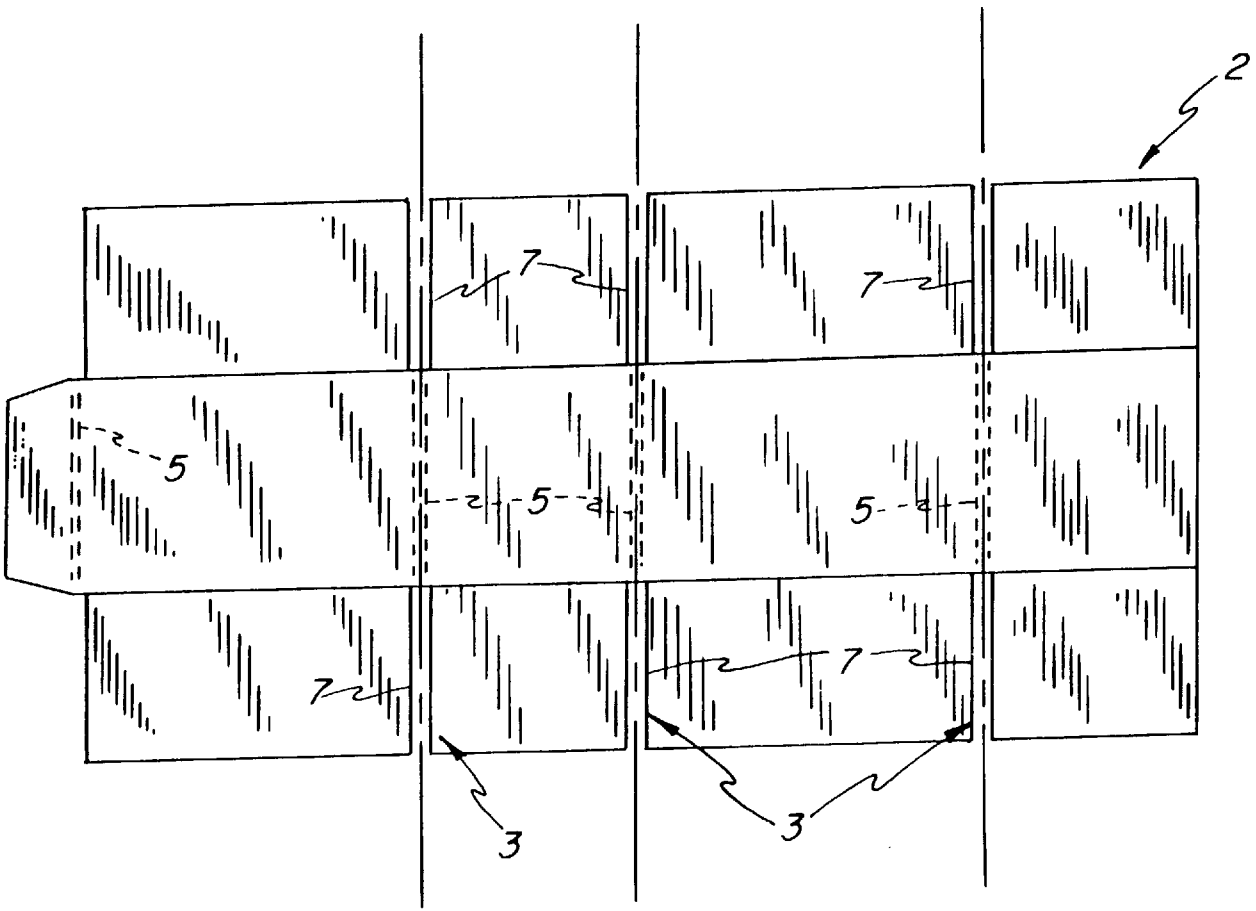
FIG. 1 is a top plan view of a processed paperboard blank.

Referring initially to FIG. 1 of the drawings, a processed paperboard blank 2 is illustrated as including a plurality of panel lines 3. Each panel line 3 includes at least one line of working which may comprise either a crease line 5 or a line of slotting 7. The blank 2 is subsequently folded at the crease lines 5 to form a box wherein the lines of slotting 7 define the various flaps of the box. As described above, it is often desirable to change the width of the crease line 5 or to produce a line of slotting 7 which is offset from the crease line 5. The method of the present invention provides an efficient process for producing a panel line 3 within a paperboard blank 2 possessing such characteristics.

Figure 2:
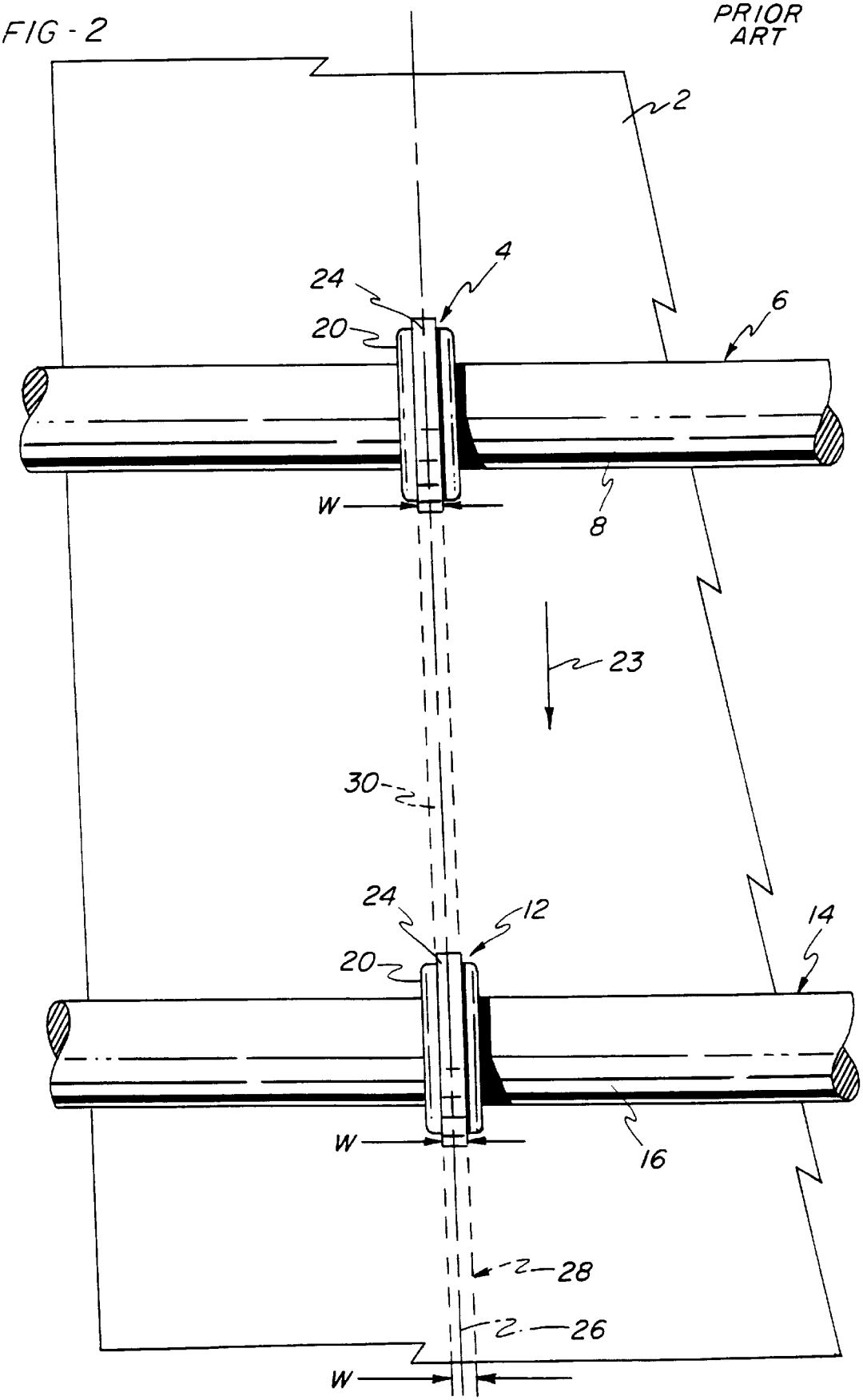
FIG - 2 PRIOR ART
FIG. 2 is a diagrammatic top plan view illustrating the scoring method of the prior art.
Figure 3:
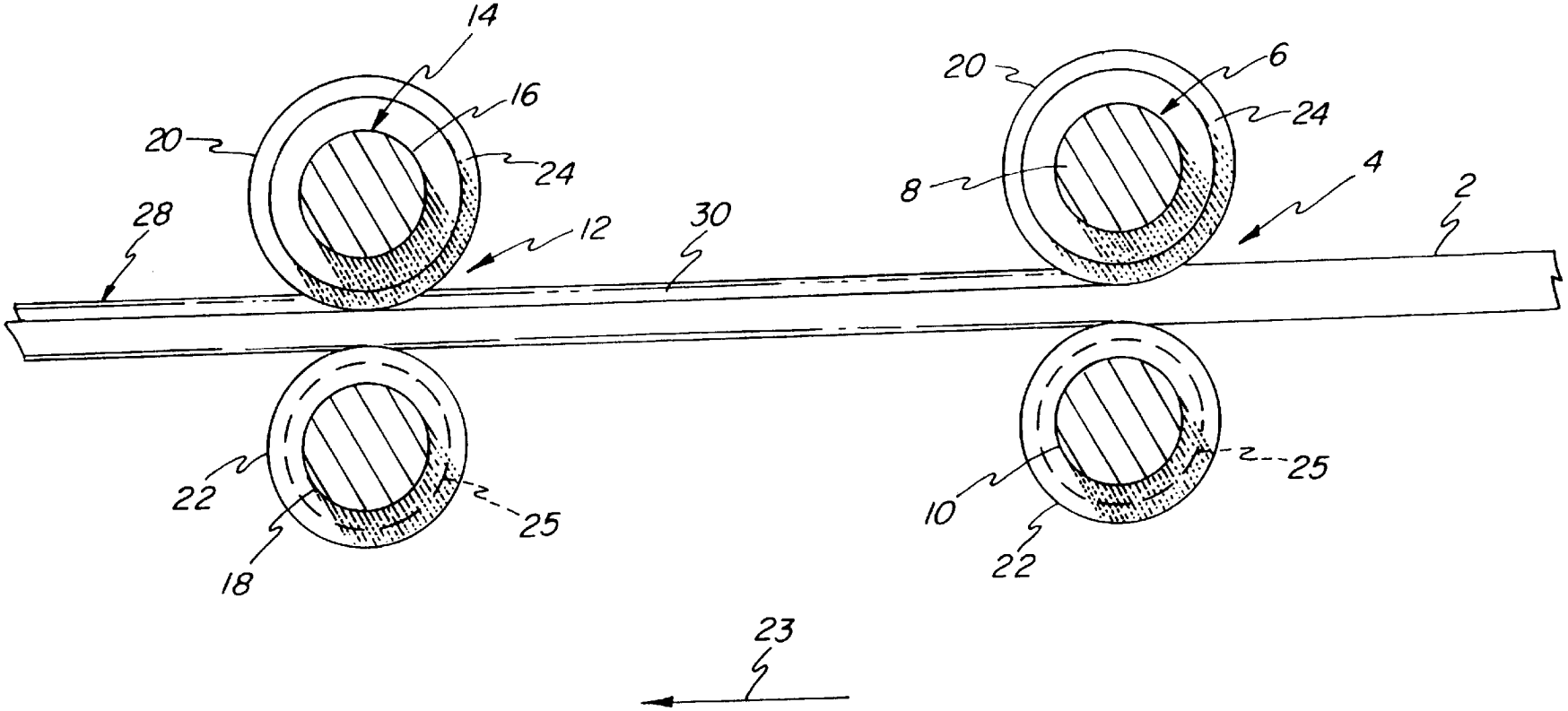
FIG. 3 is a side elevational view with a partial cutaway illustrating the scoring method of FIG. 2.

Turning now to FIGS. 2 and 3, the method of scoring a paperboard blank 2 in accordance with the above-identified prior art processes is illustrated. A first pair of cooperating scoring heads 4 is provided for rotation upon a first pair of parallel rotary shafts 6 comprising a first upper shaft 8 arranged above a first lower shaft 10. Similarly, a second pair of cooperating scoring heads 12 is provided for rotation upon a second pair of parallel rotary shafts 14 comprising a second upper shaft 16 arranged above a second lower shaft 18.

Each pair of cooperating scoring heads 4 and 12 comprises an upper scoring head 20 in a mating relationship with a lower scoring head 22 wherein the paperboard blank 2 is horizontally conveyed between the upper and lower heads 20 and 22 in the direction of arrow 23. Each upper scoring head 20 includes a scoring profile 24 having a width w. The profile 24 cooperates with a mating profile 25 formed within the respective lower scoring head 22. The profiles 24 of the first and second pairs of heads 4 and 12 are centered on common axis 26. As the paperboard blank 2 passes between the upper shafts 8 and 16 and the lower shafts 10 and 18, the profiles 24 and mating profiles 25 of the cooperating pairs of heads 4 and 12 operate upon the blank 2 in a conventional manner to form a crease line 28.

More particularly, the profile 24 of the first pair of heads 4 cooperate with the respective mating profile 25 to crush the blank 2, thereby producing a first line of scoring or score line 30 which is centered on axis 26. The upper head 20 of the second pair of cooperating heads 12 has a profile 24 in-line with the profile 24 of the first pair of heads 4, wherein the second pair of heads 12 further crush the paperboard blank 2 to form a second score line superposed over the first score line 30 and centered on axis 26 to form crease line 28. As may be appreciated from viewing FIG. 1, the resulting crease line 28 is centered on axis 26 and is of substantially the same width w as the score line 30 and profiles 24. Therefore, in order to change the width w of the crease line 28, the prior art process required that the width w of the profiles 24 be altered which required the replacement of the pairs of cooperating heads 4 and 12.

A first embodiment of the present invention is directed toward a method for changing the width of the crease line 28 without requiring the replacement of the pairs of cooperating tool heads 4 and 12.

Referring now to FIGS. 4–7, the method of the present invention is shown for use in combination with a machine 102 for working a paperboard blank 104. Only a portion of the machine 102 is shown for the purpose of illustrating the method of the present invention wherein the machine 102 may be of the type disclosed in U.S. patent application Ser. No. 08/678,555 filed on Jul. 8, 1996, which application is assigned to the assignee of the present invention and is incorporated herein by reference.

The method of scoring the paperboard blank 104 includes providing a first pair of parallel rotary shafts 106 comprising a first upper shaft 108 located directly above a first lower shaft 110. The first upper shaft 108 supports a first upper scoring head 112 and a third upper scoring head 114 for rotation wherein the first and third upper scoring heads 112 and 114 are in spaced relation to each other. First and third lower scoring heads 116 and 118 are supported for rotation on the first lower shaft 110 and cooperate with the first and third upper scoring heads 112 and 114 to define first and third pairs of scoring heads 119 and 120 respectively. Each scoring head 112, 114, 116 and 118 is independently moveable longitudinally along its respective shaft 108 and 110.

A second pair of parallel rotary shafts 121 is provided downstream from the first pair of shafts 106 and includes a second upper shaft 122 arranged directly above a second lower shaft 124. The second upper shaft 122 supports second and fourth upper scoring heads 126 and 128 for rotating movement in cooperation with second and fourth lower scoring heads 130 and 132 which are supported for rotation on the second lower shaft 124. The second upper and lower scoring heads 126 and 130 define a second pair of scoring heads 135 while the fourth upper and lower scoring heads 128 and 132 define a fourth pair of scoring heads 136. Each scoring head 126, 128, 130 and 132 is independently moveable longitudinally along its respective shaft 122 and 124.

Figure 7:
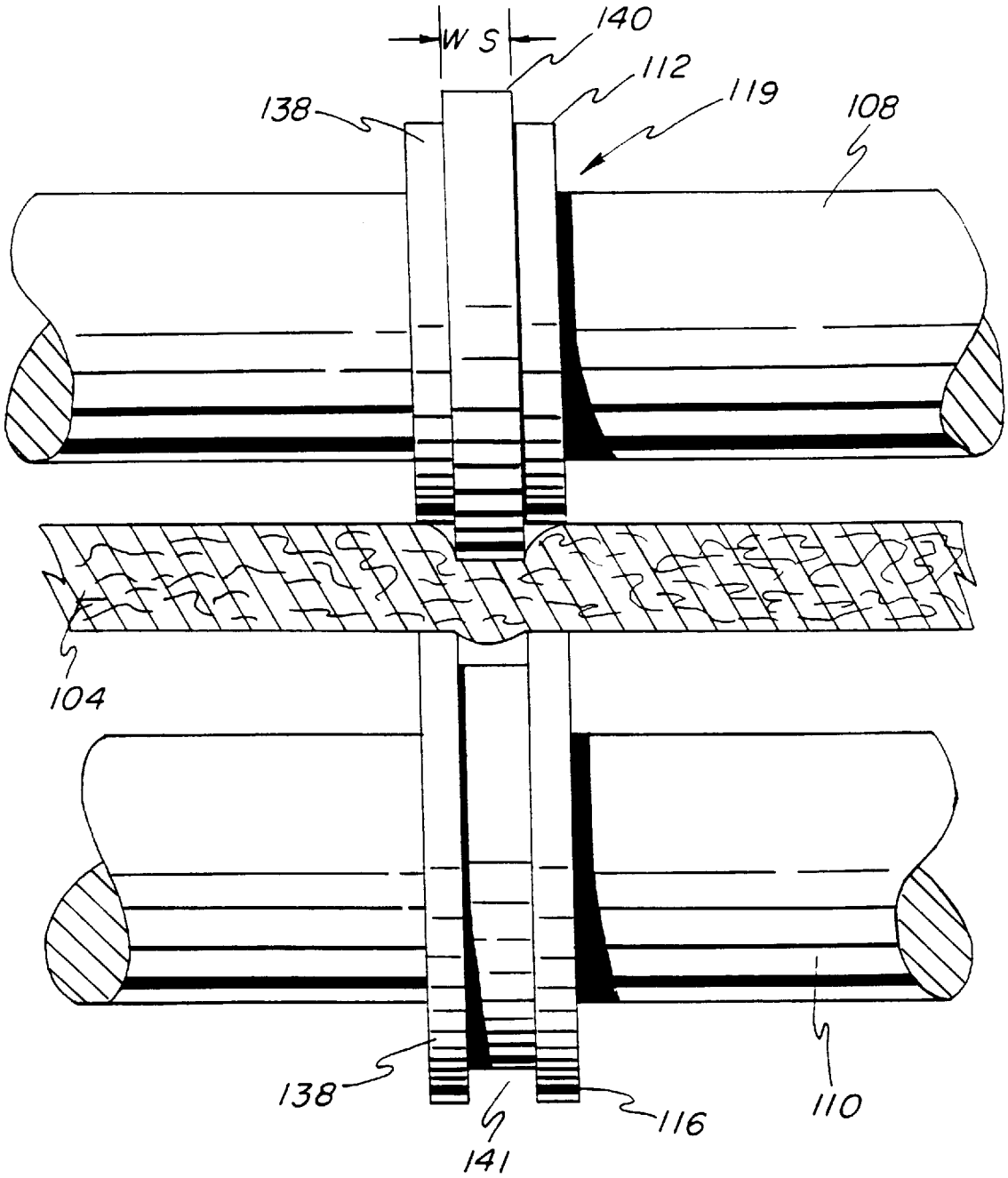
FIG. 7 is a front elevational view of a pair of cooperating scoring heads for use in the present invention.
Figure 8:
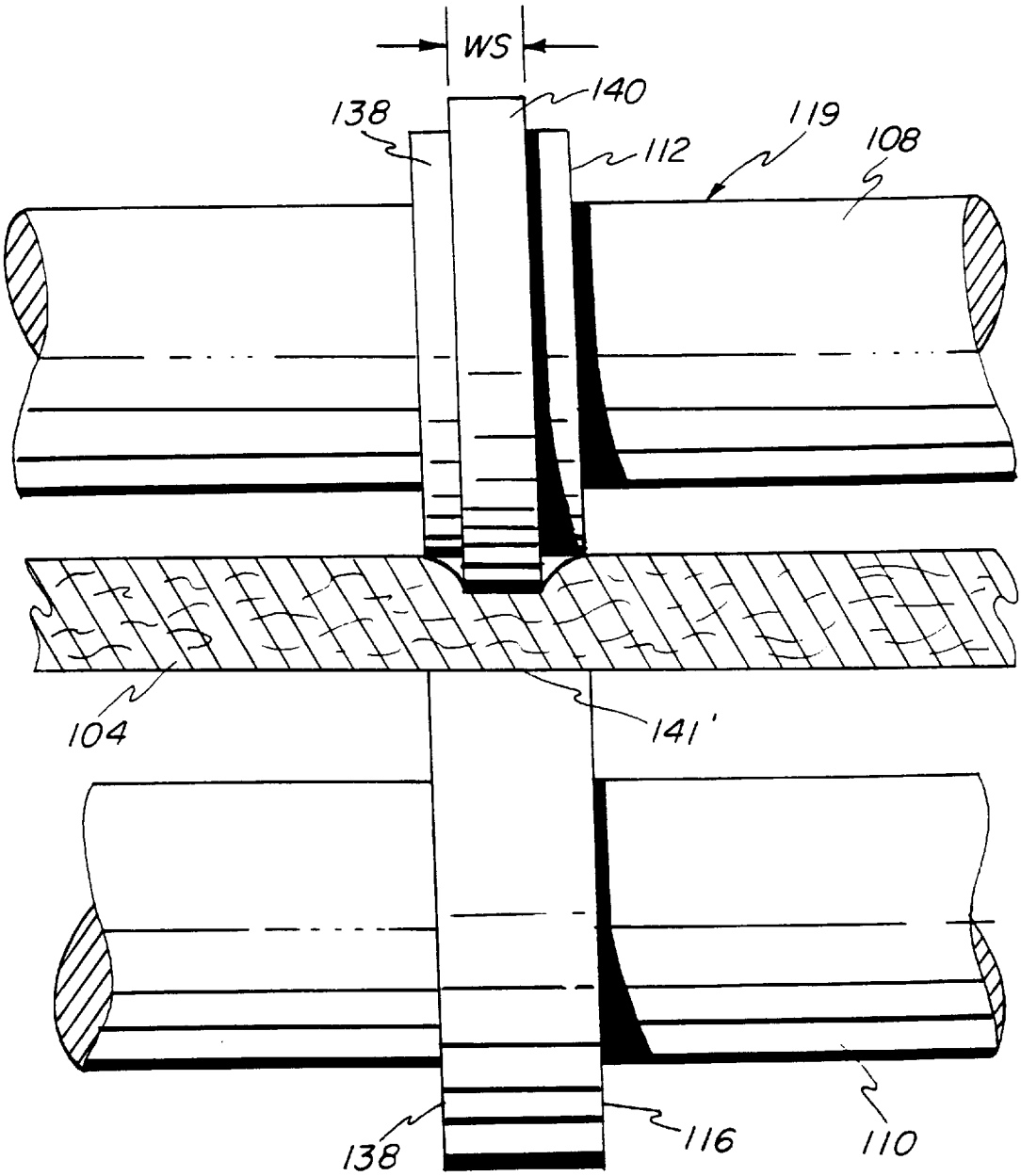
FIG. 8 is a front elevational view of a first alternative pair of cooperating scoring heads for use in the present invention.
Figure 9:
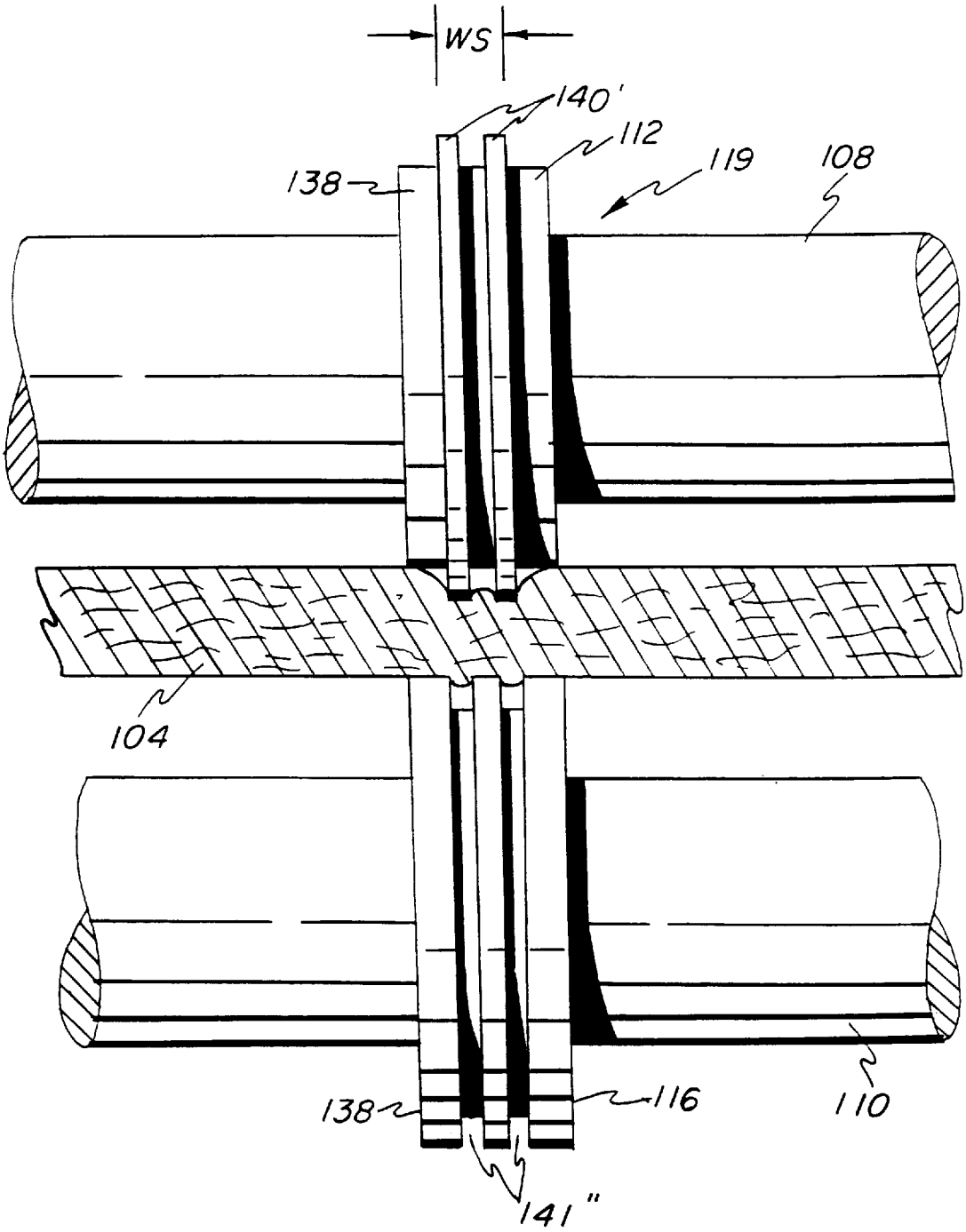
FIG. 9 is a front elevational view of a second alternative pair of cooperating scoring heads for use in the present invention.

Reference will now be made to FIG. 7 illustrating the first pair of scoring heads 119. It is to be understood that each pair of scoring heads 119, 120, 135 and 136 have a similar structure. The upper scoring heads 112, 114, 126, and 128 each include a body 138 supporting a scoring profile 140 having a width ws. A mating profile 141 is formed within a body 138 of each of lower scoring head 116, 118, 130 and 132 which cooperates with the scoring profile 140 on a mating upper scoring head 112, 114, 126 and 128, respectively. While FIG. 7 illustrates a male profile 140 cooperating with a female mating profile 141, any conventional mating scoring head arrangement may be utilized with the method of the present invention. For example, as illustrated in FIG. 8, a male profile 140 may cooperate with a planar profile 141'. Alternatively, a profile 140' having a complex shape may cooperate with a mating profile 141" as shown in FIG. 9. It should be understood that the method of the present invention may be used with any number of a wide variety of different profile configurations and shapes, and that the scope of the invention is not limited by the particular profile utilized to work the paperboard blank.

Turning again to FIGS. 4–7 the first pair of scoring heads 119 is moved to a predetermined longitudinal position along the first pair of shafts 106 wherein the profile 140 of the first upper scoring head 112 is centered on a first axis 142. Similarly, the third pair of scoring heads 120 is moved to a predetermined longitudinal position along the first pair of shafts 106 independently of the first pair of scoring heads 119 and in spaced relation thereto, wherein the profile 140 of the third upper scoring head 114 is centered on third axis 144.

Figure 4:
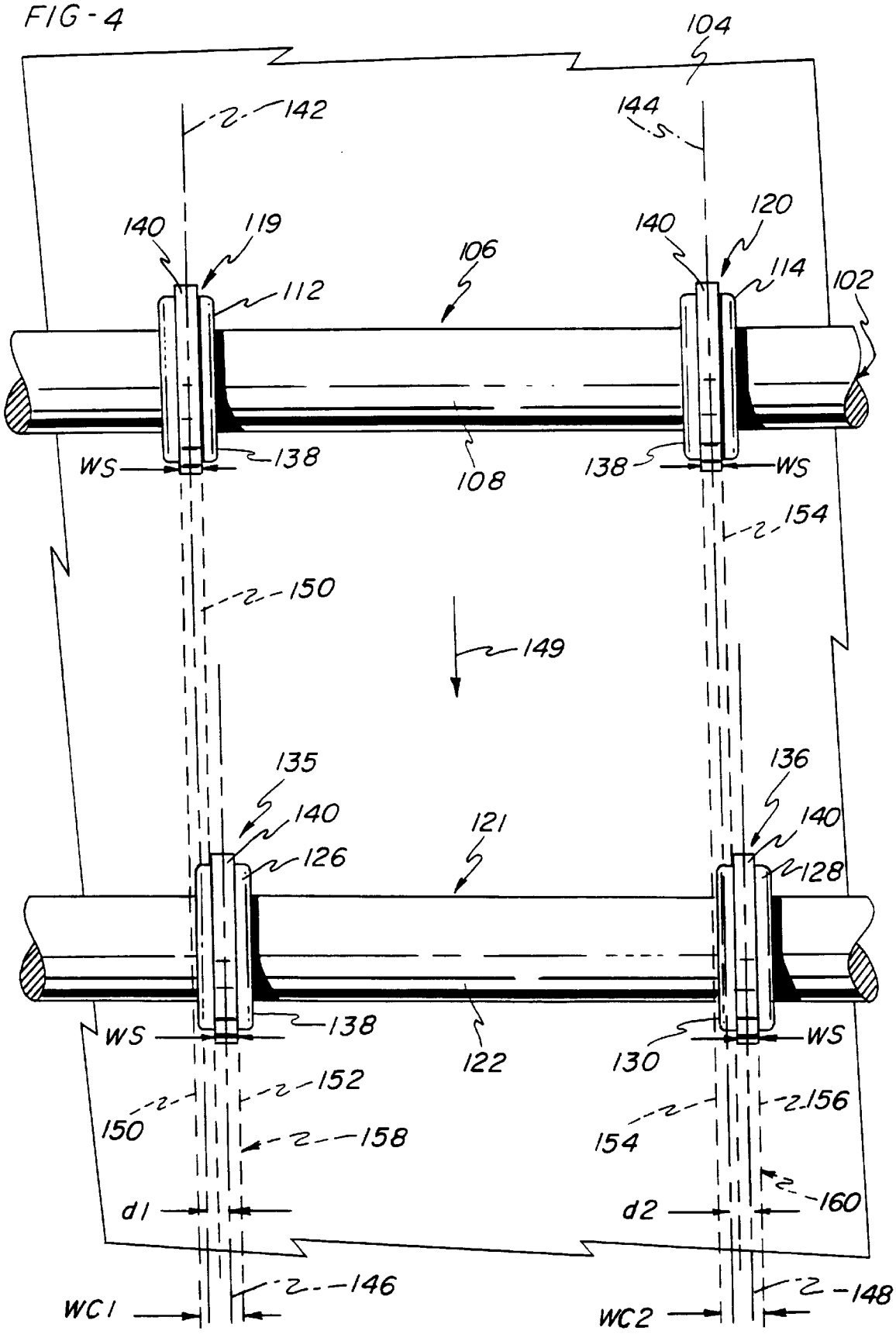
FIG. 4 is a diagrammatic top plan view illustrating a first embodiment of the method of the present invention.

Referring now to FIG. 4, the second pair of scoring heads 135 is moved to a predetermined longitudinal position along the second pair of shafts 121 wherein the profile 140 of the second upper scoring head 126 is centered on a second axis 146. The fourth pair of scoring heads 136 is moved independently of the second pair of scoring heads 135 to a longitudinal position along the second pair of shafts 121, wherein the profile 140 of the fourth upper scoring head 128 is centered on a fourth axis 148. As seen in FIG. 4, the first axis 142 is separated from the second axis 146 by a distance d1 while the third axis 144 is separated from the fourth axis 148 by a distance d2.

The paperboard blank 104 is conveyed between the upper and lower shafts 108, 122 and 110, 124 in the direction of arrow 149, wherein the profiles 140 and mating profiles 141 of the cooperating pairs of heads 119, 120, 135 and 136 operate upon the blank 104 to form lines of scoring or score lines 150, 152, 154 and 156. More particularly, the profile 140 and mating profile 141 of the first pair of scoring heads 119 cooperate to crush the paperboard blank 104 and form a first line of scoring 150 centered about the first axis 142. In a similar manner, the profile 140 and mating profile 141 of the second pair of scoring heads 135 form a second line of scoring 152 centered about the second axis 146. Both the first and second lines of scoring 150 and 152 have a width substantially equal to the width ws of the profiles 140 of the upper scoring heads 112 and 126, respectively. It is readily apparent that the centers 142 and 146 of the first and second lines of scoring 150 and 152 are therefore separated by the distance d1 defined by the offset between the profiles 140 of the first and second pairs of heads 119 and 135. The first and second lines of scoring 150 and 152 together define a first crease line 158 having a width wc1 which is greater than the width ws of either the first or second lines of scoring 150 or 152.

The profile 140 and mating profile 141 of the third pair of scoring heads 120 cooperate to form a third line of scoring 154 on the paperboard blank 104 centered about the third axis 144. In similar fashion, the fourth pair of scoring heads 136 form a fourth line of scoring 156 centered about the fourth axis 148. Both the third and fourth lines of scoring 154 and 156 each have a width substantially equal to the width ws of the profiles 140 of the upper scoring heads 114 and 128, respectively. The centers 144 and 148 of the third and fourth lines of scoring 154 and 156 are therefore separated by the distance d2 based upon the offset of the profiles 140 of the third and fourth pairs of scoring heads 120 and 136. The third and fourth lines of scoring 154 and 156 together define a second crease line 160 of width wc2 which is greater than the width ws of either the third or fourth lines of scoring 154 or 156.

As seen in FIG. 4, if the first and second lines of scoring 150 and 152 are offset by a value of d1 equal to or less than half the sum of the combined width ws of the profiles 140 of the first and second pairs of heads 119 and 135, then the first crease line 158 comprises abutting or overlapping first and second score lines 150 and 152. Likewise, if the third and fourth lines of scoring 154 and 156 are offset by a value of d2 equal to or less than half the sum of the combined width ws of the profiles 140 of the third and fourth pairs of heads 120 and 136, then the second crease line 160 comprises abutting or overlapping third and fourth score lines 154 and 156.

Figure 10:
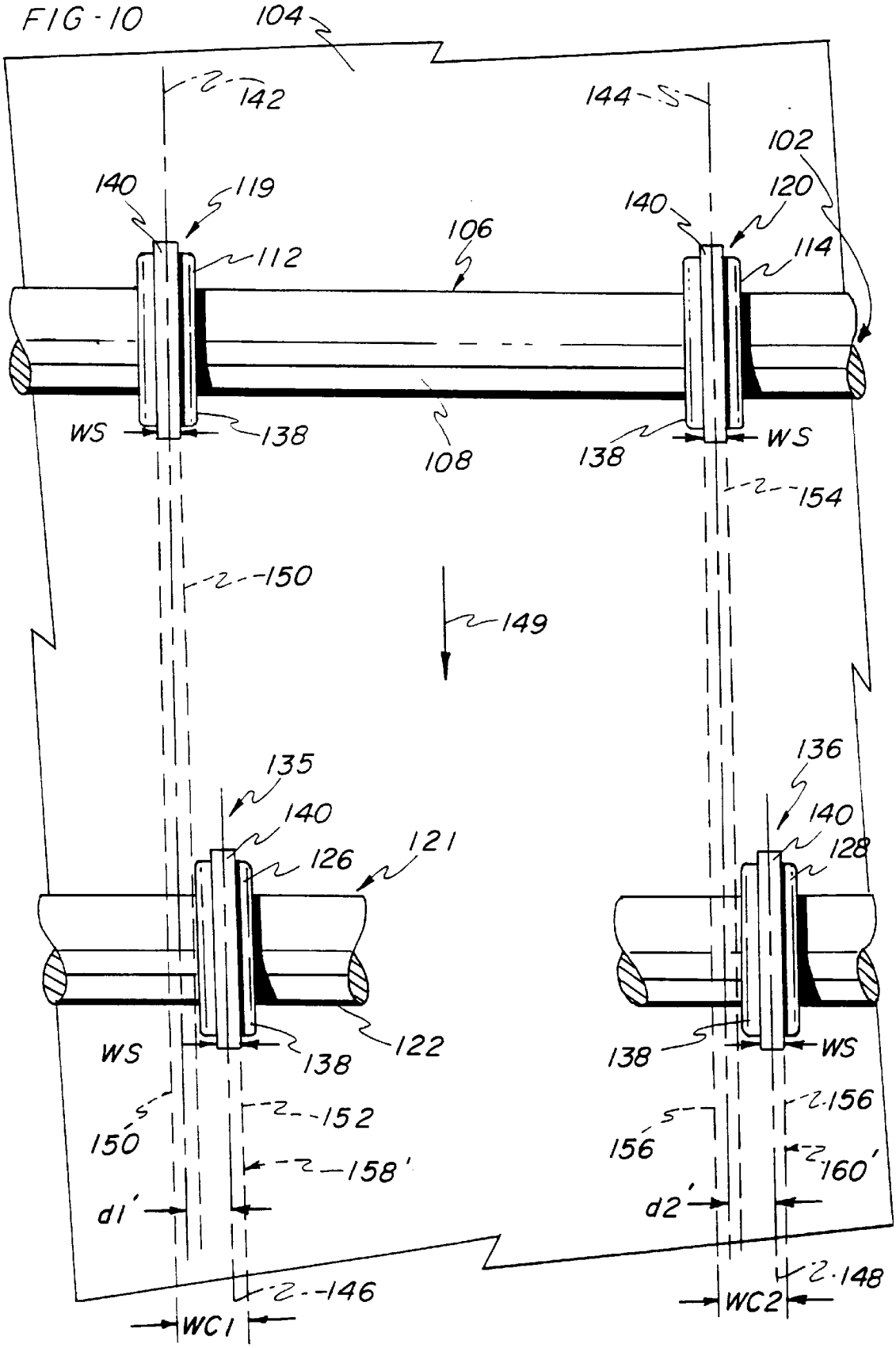
FIG. 10 is a diagrammatic top plan view illustrating a further embodiment of the method of the present invention.

Turning now to FIG. 10, the lines of scoring 150 and 152 may be offset by a value d1' which is slightly greater than half the sum of the combined width ws of the profiles 140 of the first and second pairs of heads 119 and 135, wherein a first crease line 158' having a width wc1' is defined by the first line of scoring 150 in spaced relation and adjacent to the second line of scoring 152. Similarly, the lines of scoring 154 and 156 may be offset by a value d2' which is slightly greater than half the sum of the combined width ws of the profiles 140 of the third and fourth pairs of heads 120 and 136, wherein a second crease line 160' having a width wc2' is defined by a third line of scoring 154 in spaced relation and adjacent to the fourth line of scoring 156.

If either of the first or second crease lines 158 or 160 are formed by overlapping lines of scoring 150, 152 or 154, 156, then the crease line 158 or 160 defines an area about which a single fold of the paperboard blank 104 is formed. Lines of scoring 150, 152 or 154, 156 which are adjacent to each other form a crease line 158' or 160' defining an area about which a pair of folds of the paperboard blank 104 are formed to create a hinge.

As described above, it is often desirable to change the width of the crease lines 158 and 160 depending upon the thickness or caliper of the paperboard blank 104. With the method of the present invention, only one pair of scoring heads 119, 120, 135 and 136 needs to be displaced to change the width wc1 and wc2 of any one of the crease lines 158 and 160. More particularly, if the thickness of the paperboard blank 104 increases, then one of the first and second pairs of scoring heads 119 and 135 is displaced relative to the other such that the distance d1 between the axes 142 and 146 is increased to form a first crease line 158 of increased width wc1. Similarly, with an increase in paperboard blank 104 thickness, one of the third and fourth pairs of scoring heads 120 and 136 is displaced relative to the other wherein the distance d2 between the axes 144 and 148 is increased to form a second crease line 160 of increased width wc2.

If the thickness of the paperboard blank 104 is decreased, one of the first and second pairs of scoring heads 119 and 135 is displaced relative to the other wherein the distance d1 between the axes 142 and 146 is decreased thereby forming a first crease line 158 of decreased width wc1. Likewise, one of the third and fourth pairs of scoring heads 120 and 136 is displaced relative to the other wherein the distance d2 between the axes 144 and 148 is decreased to form a second crease line 160 of decreased width wc2 in response to a thinner paperboard blank 104. It should be noted that each pair of scoring heads 119, 120, 135, and 136 may be moved independently of each other wherein the width wc1 of the first crease line 158 may be adjusted independently of the width wc2 of the second crease line 160.

From the above description, it should be apparent that the present invention provides for an improved method of forming crease lines of different widths on a paperboard blank wherein the scoring heads do not need to be replaced to change the crease line width. Therefore, fewer tool heads are required to process paperboard blanks having crease lines of different width.

Accordingly, the method of scoring paperboard blanks of the present invention provides for increased production efficiency at a reduced cost. Further, the method of the present invention provides for an accurately dimensioned crease line without cracking the paperboard blank since the formation of the crease line occurs in two steps by forming a first line of scoring and then forming a second line of scoring offset from the first line of scoring. The method of the present invention produces a dependable crease line about which a fold of the paperboard blank is formed.

Figure 11:
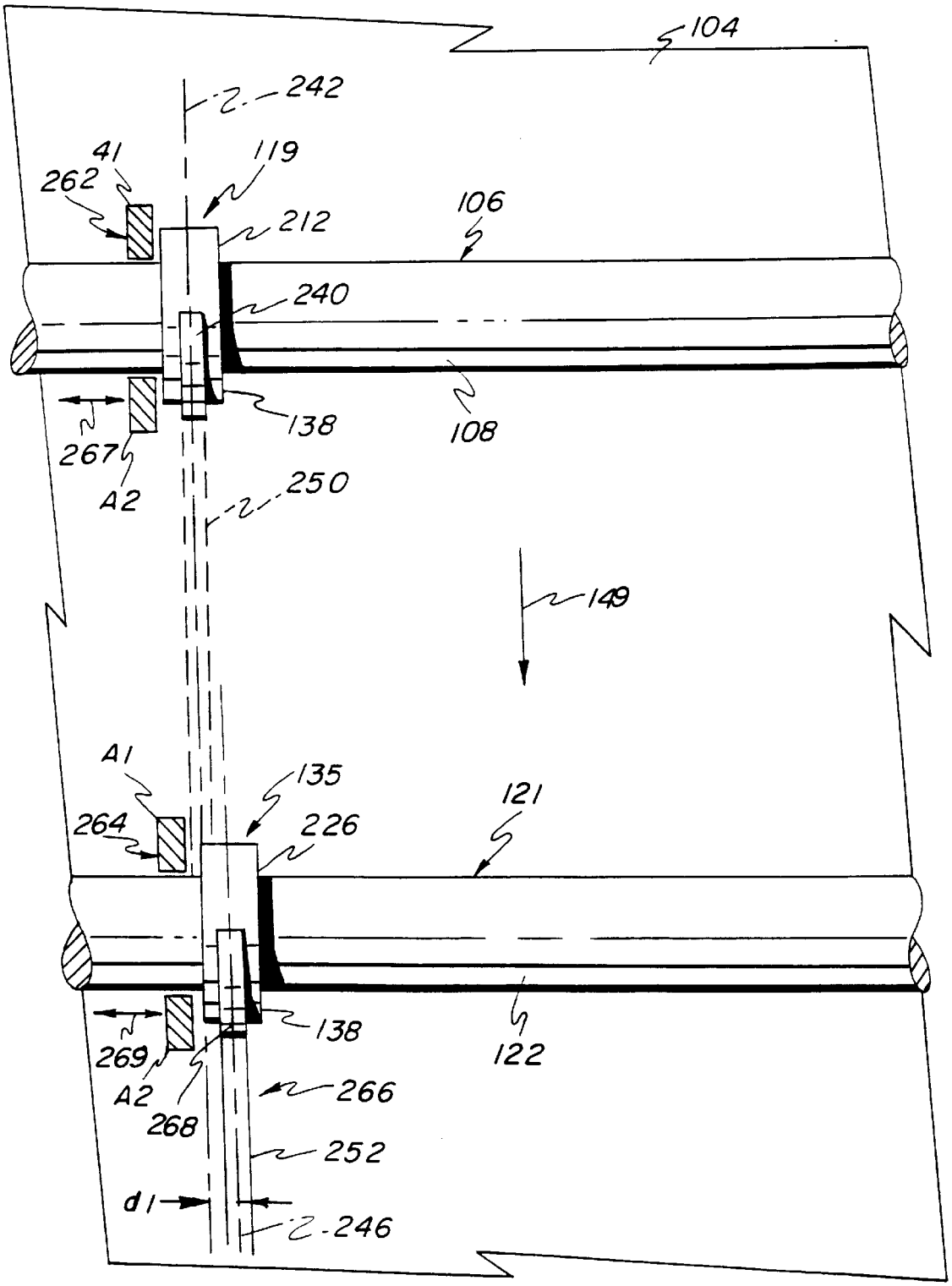
FIG. 11 is a diagrammatic top plan view illustrating yet another embodiment of the method of the present invention.
Figure 12:
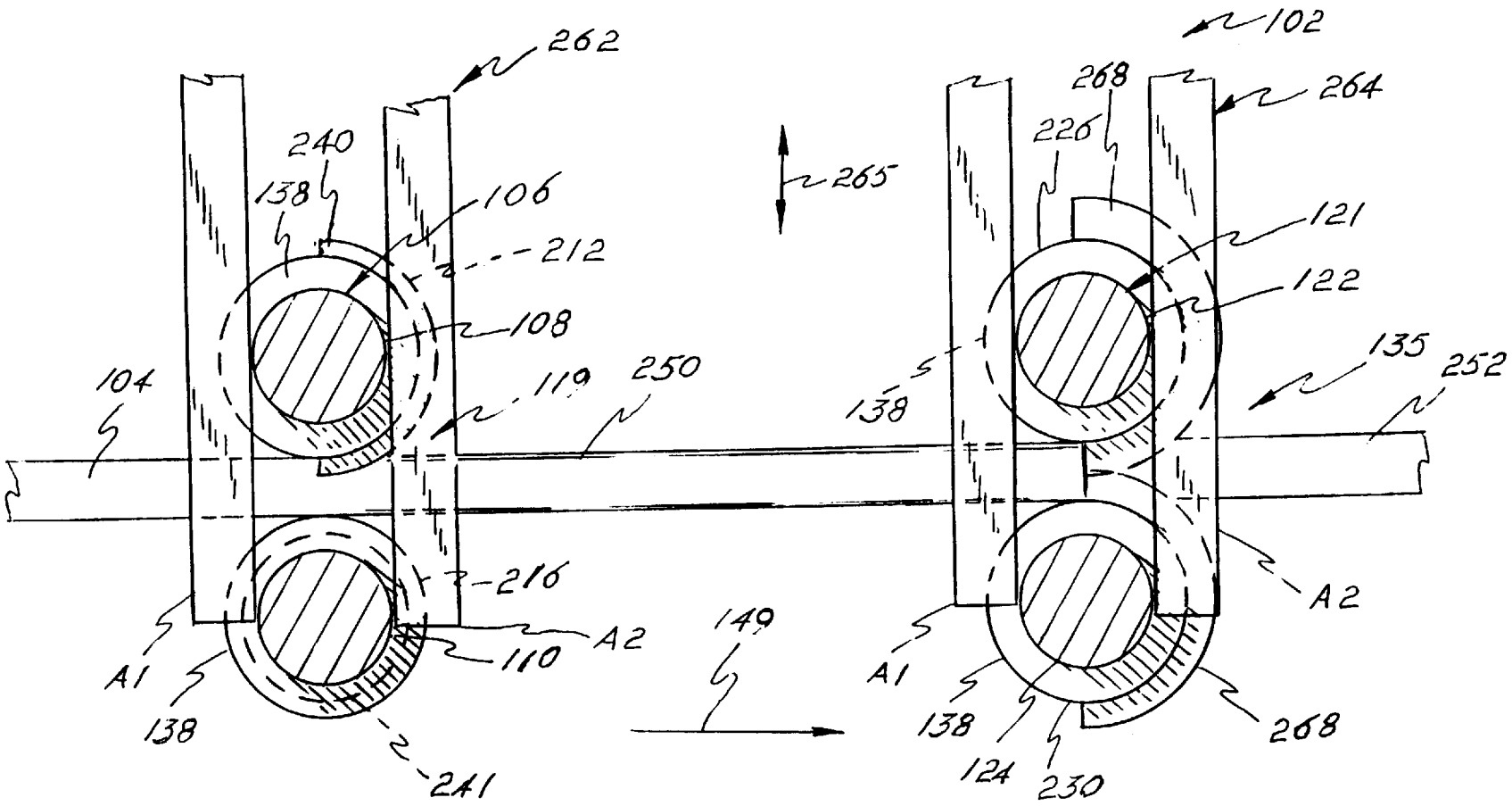
FIG. 12 is a left side elevational view with a partial cutaway illustrating the method of FIG. 11.

Turning now to FIGS. 11–12, a further embodiment of the present invention is illustrated wherein identical reference numerals designate the same components as identified above. The method of this embodiment provides a method of automatically displacing tool heads to form offset lines of working on a paperboard blank 104. It is intended that this method be used in combination with the machine 102 as disclosed in U.S. patent application Ser. No. 08/678,555, filed on Jul. 8, 1996 and as incorporated herein by reference.

Figure 5:
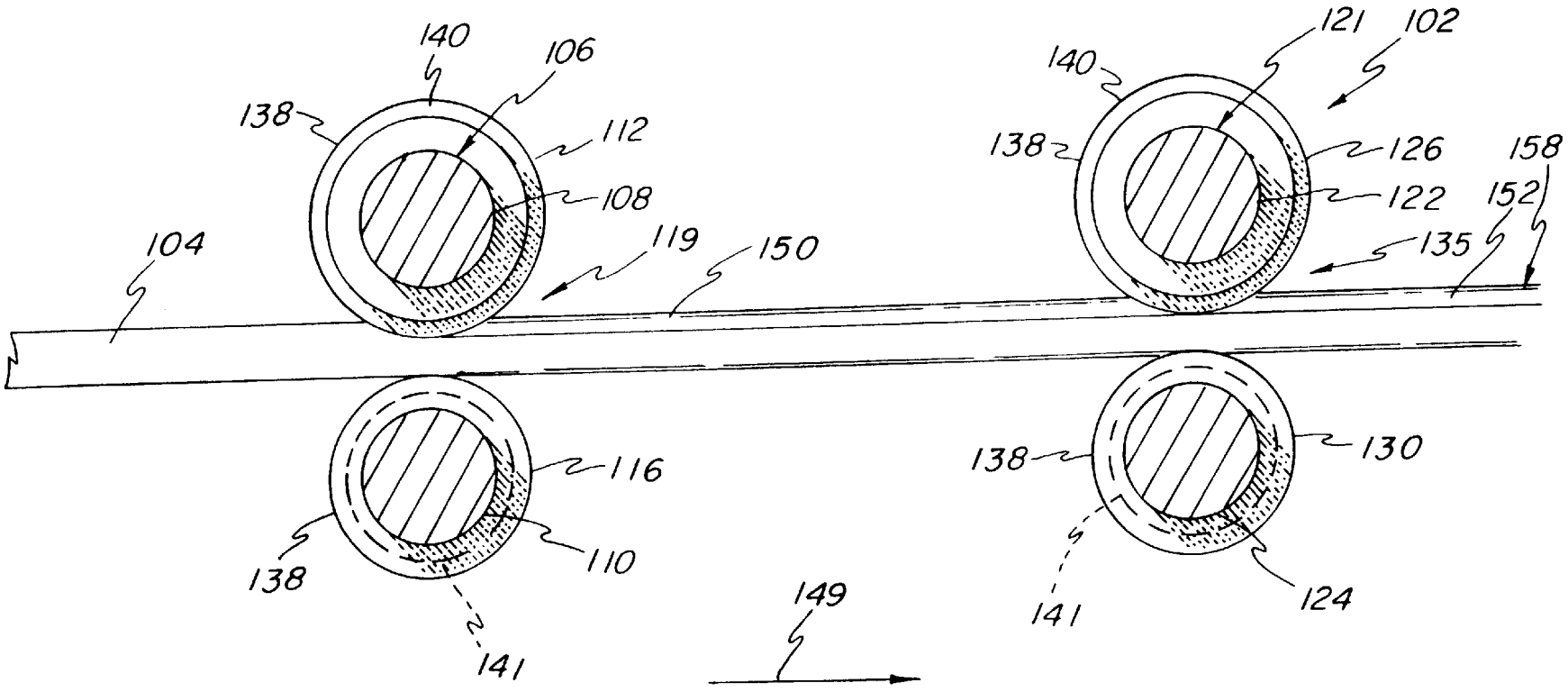
FIG. 5 is a left side elevational view with a partial cutaway illustrating the method of FIG. 4.
Figure 6:
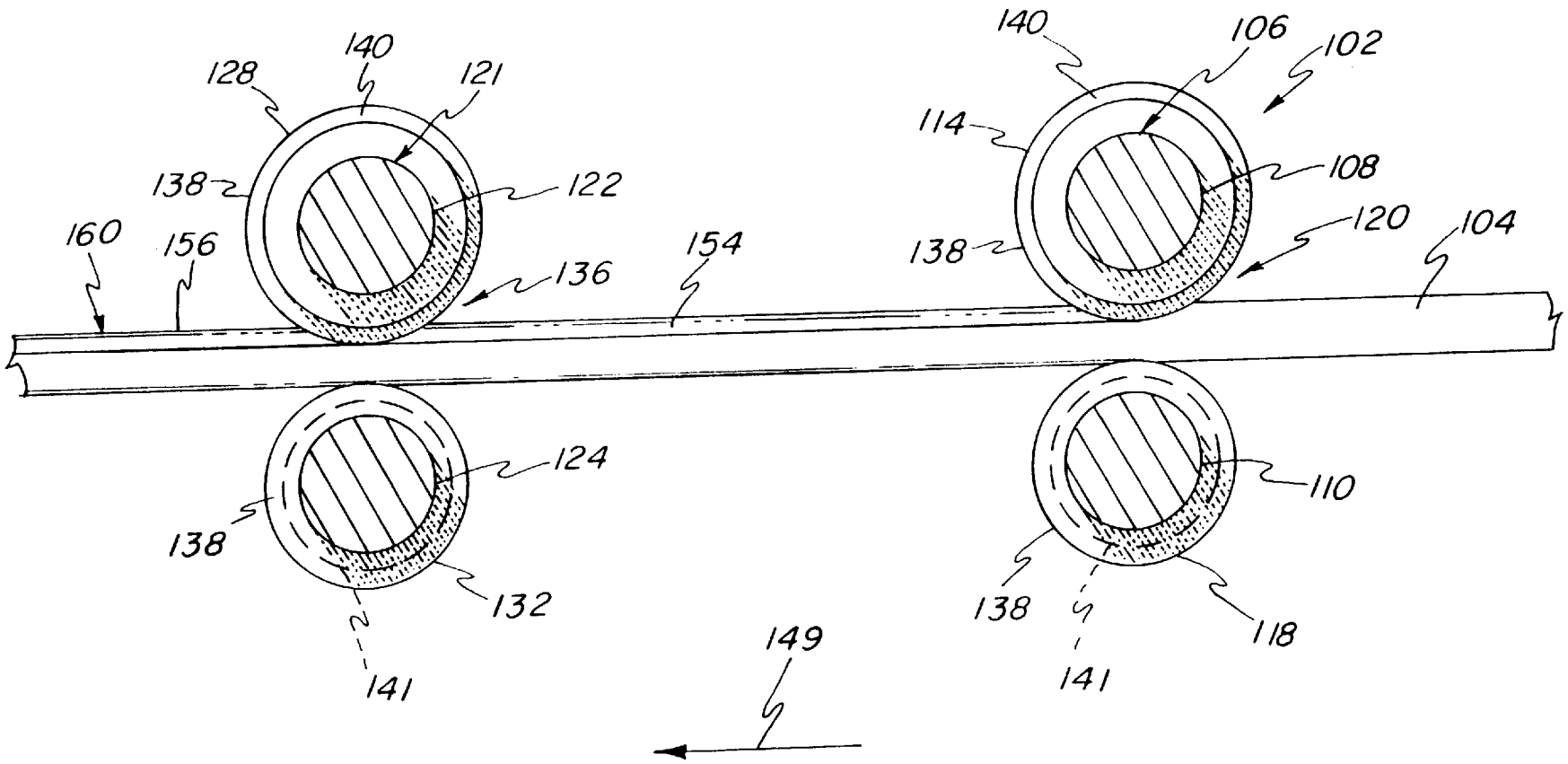
FIG. 6 is a right side elevational view with a partial cutaway illustrating the method of FIG. 4.

The method of this embodiment is similar to that disclosed above in reference to FIGS. 4–6 in that first and second pairs of parallel rotary shafts 106 and 121 are provided for supporting first and second pairs of tool heads 119 and 135, respectively.

As disclosed in U.S. patent application Ser. No. 08/678,555, first and second coupling members 262 and 264 are associated with the first and second pairs of parallel rotary shafts 106 and 121. As illustrated in FIG. 12, each coupling member 262 and 264 includes a pair of spaced arms A1, A2 adapted to extend downwardly to either side of the respective pairs of shafts 106 and 121. An actuator (not shown) is connected to each coupling member 262 and 264 for linearly moving each coupling member 262 and 264 in a vertical direction as indicated by arrow 265.

More particularly, the coupling members are linearly moved downwardly to a position adjacent the pairs of tool heads 119 and 135. With the arms A1 and A2 thus positioned, the first coupling member 262 may be linearly moved in a direction parallel to the first pair of shafts 106, as indicated by arrow 267 in FIG. 11, whereby the first pair of tool heads 119 will be slid along shafts 108 and 110 to a predetermined longitudinal position to define a first line of working 250. Likewise, the second coupling member 264 may be linearly moved in a direction parallel to the second pair of shafts 121, indicated by arrow 269 in FIG. 11, such that the second pair of tool heads 135 will be displaced to a predetermined longitudinal position along the second pair of shafts 121 to define a second line of working 252. The tool heads 119 and 135 are positioned so that a center 242 of the first line of working 250 is displaced relative to a center 246 of the second line of working 252 by distance d1.

Following the positioning of the heads 119 and 135, the coupling members 262 and 264 are linearly moved upwardly to a position above the respective pairs of shafts 106 and 121. The paperboard blank 104 is next conveyed between upper and lower shafts 108, 122 and 110, 124 in the direction of arrow 149, whereby the first and second pairs of tool heads 119 and 135 operate upon the blank 104 to form a panel line 266.

As seen in FIG. 11, the first and second lines of working 250 and 252 define the panel line 266 wherein the first line of working 250 may comprise a line of scoring formed by cooperating scoring heads 212 and 216. The second line of working 252 may comprise a line of slotting formed by cooperating slotting heads 226 and 230. The upper scoring head 212 includes a body 138 supporting a scoring profile 240. A mating profile 241 is formed within a body 138 of the lower scoring head 216, wherein the profile 241 cooperates with the profile 240 on the mating upper scoring head 212 for scoring the blank 104 in the manner described above. The slotting heads 226 and 230 each have bodies 138 supporting cooperating blades 268 for slotting the blank 104 in a manner as is well known in the art. It should be understood that the method of the present invention may be used with tool heads arranged in other conventional sequences, such as score-slot, slot-score, or others as viewed in the direction of paperboard travel 149. Any number or combination of a wide variety of tool heads may be utilized with the present invention. Further, the particular design of the profiles 240 and blades 268 of the tool heads 119 and 135 does not limit the scope of the invention.

From the above description, it should be apparent that the present invention further provides for a method of displacing tool heads to form offset lines of working on a paperboard blank without requiring the manual repositioning of the tool heads. Accordingly, the method of the present invention provides for increased production efficiency at a reduced cost.

While the methods of operation herein described constitute preferred embodiments of this invention, it is to be understood that the invention is not limited to these precise methods, and that changes may be made therein without departing from the scope of the invention which is defined in the appended claims.

What is claimed is:

1. A method of forming different predetermined crease line widths on paperboard blanks in a machine for working paperboard blanks, said method comprising the steps of:

providing a fist pair of parallel rotary shafts arranged one over the other and supporting a first pair of scoring heads comprising first upper and lower cooperating scoring heads for defining a first line of scoring having a first scoring width;

providing downstream of said first upper and lower cooperating scoring heads a second pair of parallel rotary shafts arranged one over the other and supporting a second pair of scoring heads comprising second upper and lower cooperating scoring heads for defining a second line of scoring having a second scoring width;

moving said first pair of scoring heads to a predetermined longitudinal position along said first pair of shafts to define a first central axis of said first line of scoring;

moving said second pair of scoring heads to a predetermined longitudinal position along said second pair of shafts to define a second central axis of said second line of scoring wherein said first central axis of said first line of scoring is displaced relative to said second central axis of said second line of scoring;

conveying a paperboard blank between said first and second pairs of scoring heads whereby said fist and second pairs of scoring heads form said first and second lines of scoring on the paperboard blank, said first and second lines of scoring forming a crease line of a predetermined width on said paperboard blank while said second line of scoring remains in overlapping alignment with said first line of scoring such that said predetermined width of said crease line is greater than said first scoring width and is greater than said second scoring width; and displacing at least one of said first and second pair of scoring heads longitudinally along said first and second pairs of shafts relative to the other one of said first and second pairs of scoring heads while said second line of scoring remains in overlapping alignment with said first line of scoring for selectively changing the width of said crease line so as to form a different predetermined crease line width on some subsequently conveyed paperboard blank.

2. The method of claim 1 wherein said crease line defines an area about which a single fold of said paperboard blank is formed.

3. The method of claim 1 wherein said step of displacing one of said first and second pairs of scoring heads comprises displacing said one of said first and second pairs of scoring heads such that said first and second central axes of said first and second lines of scoring are displaced a predetermined distance from each other to increase the width of said crease line.

4. The method of claim 1 wherein said step of displacing one of said first and second pairs of scoring heads comprises displacing said one of said first and second pairs of scoring heads such that said first and second central axes of said first and second lines of scoring are displaced a predetermined distance from each other to decrease the width of said crease line.

5. The method of claim 1 further including the steps of:

providing a third pair of scoring heads supported on said first pair of shafts and a fourth pair of scoring heads supported on said second pair of shafts;

positioning said third pair of scoring heads to a predetermined longitudinal position along said first pair of shafts to define a third line of scoring having a third central axis;

positioning said fourth pair of scoring heads to a predetermined longitudinal position along said second pair of shafts to define a fourth line of scoring having a fourth central axis wherein said third central axis of said third line of scoring is displaced relative to said fourth central axis of said fourth line of scoring; and conveying a paperboard blank between said third and fourth pairs of scoring heads whereby said third and fourth pairs of scoring heads form said third and fourth lines of scoring on the paperboard blank, wherein said third and fourth lines of scoring form a second crease line of a predetermined width on said paperboard blank at a location spaced from said crease line formed by said first and second pairs of scoring heads.

6. The method of claim 5 wherein said step of positioning said third pair of scoring heads comprises moving said third pair of scoring heads independently of said first pair of scoring heads and said step of positioning said fourth pair of scoring heads comprises moving said fourth pair of scoring heads independently of said second pair of scoring heads.

7. A method of forming different predetermined crease line widths on paperboard blanks in a machine for working paperboard blanks, said method comprising the steps of:

providing a first pair of parallel rotary shafts arranged one over the other and supporting a first pair of scoring heads comprising first upper and lower cooperating scoring heads for defining a first line of scoring having a first scoring width;

providing downstream of said first upper and lower cooperating scoring heads a second pair of parallel rotary shafts arranged one over the other and supporting a second pair of scoring heads comprising second upper and lower cooperating scoring heads for defining a second line of scoring having a second scoring width;

moving said first pair of scoring heads to a predetermined longitudinal position along said first pair of shafts to define a first central axis of said first line of scoring;

moving said second pair of scoring heads to a predetermined longitudinal position along said second pair of shafts to define a second central axis of said second line of scoring wherein said second central axis of said second line of scoring is displaced relative to said first central axis of said first line of scoring;

conveying a paperboard blank of predetermined thickness between said first and second pairs of scoring heads whereby said first and second pairs of scoring heads form said first and second lines of scoring on the paperboard blank, said fist and second lines of scoring forming a crease line of a predetermined width on said paperboard blank while said second line of scoring remains in overlapping alignment with said first line of scoring such that said predetermined width of said crease line is greater than said first scoring width and is greater than said second scoring width; and changing the displacement of said second central axis of said second line of scoring relative to said first central axis of said first line of scoring while said second line of scoring remains in overlapping alignment with said first line of scoring for selectively changing the width of said crease line formed on some paperboard blank subsequently conveyed between said first and second pairs of scoring heads.

8. The method of claim 7 wherein said step of changing the displacement of said second central axis of said second line of scoring relative to said first central axis of said first line of scoring comprises increasing the displacement of said second central axis of said second line of scoring from said first central axis of said first line of scoring to form a wider crease line on a paperboard blank having a thickness greater than said predetermined thickness.

9. The method of claim 7 wherein said step of changing the displacement of said second central axis of said second line of scoring relative to said first central axis of said first line of scoring includes reducing the displacement of said second central axis of said second line of scoring from said first central axis of said first line of scoring to form a narrower crease line on a paperboard blank having a thickness less than said predetermined thickness.

10. A method of forming different predetermined panel line widths on paperboard blanks, said method comprising the steps of:

providing a first pair of parallel rotary shafts arranged one over the other and supporting a first pair of tool heads comprising first upper and lower cooperating tool heads for defining a first line of working having a first working width;

providing downstream of said first upper and lower cooperating tool heads a second pair of parallel rotary shafts arranged one over the other and supporting a second pair of tool heads comprising second upper and lower cooperating tool heads for defining a second line of working having a second working width;

providing a first coupling member associated with said first pair of parallel rotary shafts;

providing a second coupling member associated with said second pair of parallel rotary shafts;

linearly moving said first coupling member to a position adjacent said first pair of tool heads;

moving said first coupling member for positioning said first pair of tool heads at a predetermined longitudinal position along said first pair of shafts to define a first central axis of said first line of working;

linearly moving said second coupling member to a position adjacent said second pair of tool heads;

moving said second coupling member for positioning said second pair of tool heads at a predetermined longitudinal position along said second pair of shafts to define a second central axis of said second line of working wherein said first central axis of said first line of working is displaced relative to said second central axis of said second line of working;

conveying a paperboard blank between said first and second pairs of tool heads whereby said first and second pairs of tool heads form said first and second lines of working on the paperboard blank, said first and second lines of working forming a panel line of a predetermined width on said paperboard blank while said second line of working remains in overlapping alignment with said first line of working such that said predetermined width of said panel line is greater than said first working width and is greater than said second working width; and displacing at least one of said first and second pairs of tool heads longitudinally along said first and second pairs of shafts relative to the other one of said first and second pairs of tool heads to change the displacement of said first central axis of said first line of working relative to said second central axis of said second line of working while said second line of working remains in overlapping alignment with said first line of working for selectively changing the width of said panel line formed on some subsequently conveyed paperboard blank.

11. The method of claim 10 wherein said first line of working comprises a first line of scoring.

12. The method of claim 11 wherein said second line of working comprises a second line of scoring.

13. The method of claim 11 wherein said second line of working comprises a line of slotting.

* * * * *